US006701645B1

(12) United States Patent
Forrester

(10) Patent No.: US 6,701,645 B1
(45) Date of Patent: Mar. 9, 2004

(54) ROTATABLE TRACTION PAD FOR ATHLETIC SHOE

(76) Inventor: Randolph S. Forrester, 178 Clarks Mills Rd., Dayton, ME (US) 04005

( * ) Notice: Subject to any disclaimer, the term of this patent is extended or adjusted under 35 U.S.C. 154(b) by 0 days.

(21) Appl. No.: 10/317,287

(22) Filed: Dec. 13, 2002

(51) Int. Cl.[7] ..... A43B 5/00
(52) U.S. Cl. ..... 36/134; 36/39; 36/128; 36/126
(58) Field of Search ..... 36/134, 39, 128, 36/126, 8.3

(56) References Cited

U.S. PATENT DOCUMENTS 2,535,102 A * 12/1950 Walton ..... 36/38
3,204,348 A * 9/1965 Latson ..... 36/8.3
3,354,561 A * 11/1967 Cameron ..... 36/134
5,566,478 A * 10/1996 Forrester ..... 36/134

FOREIGN PATENT DOCUMENTS

GB 2144024 * 2/1985

* cited by examiner

*Primary Examiner*—Ted Kavanaugh
(74) *Attorney, Agent, or Firm*—Frederick R. Cantor, Esq.

(57) ABSTRACT

A rotatable traction pad for a shoe can be mounted in a circular cavity in the shoe sole bottom surface, with the cavity being relatively shallow in relation to the shoe sole thickness. The pad mounting mechanism can include an annular bearing housing adhesively bonded to the circular side surface of the cavity, and an anti-friction bearing carried within the annular housing. The traction pad includes a rigid central post that extends upwardly through the bearing.

14 Claims, 2 Drawing Sheets

ROTATABLE TRACTION PAD FOR ATHLETIC SHOE

FIELD OF THE INVENTION

This invention relates to athletic shoes, and particularly to athletic shoes having rotatable traction pads that facilitate quick turning maneuvers. The invention has application to various types of athletic shoes, including basketball shoes, tennis shoes, baseball shoes, football shoes, dance shoes, cheerleader shoes, aerobic workout shoes, and specialized work boots.

BACKGROUND OF THE INVENTION

In various sports activities a person may be required to swivel his foot to execute a change of direction. My U.S. Pat. No. 5,566,478 discloses a sports shoe equipped with a rotatable traction pad for enabling the person to execute a directional change without unduly stressing the person's ankle. During a turning maneuver the traction pad becomes anchored to the ground (or floor surface, while the shoe rotates around the traction pad rotational axis, whereby the person's foot can rotate with the rest of his body. The traction pad has features, whereby it can be easily removed from the shoe for cleaning the pad or removing debris that might interfere with pad rotation. Another traction pad is shown in U.S. Pat. No. 3,354,561 issued to B. M. Cameron.

SUMMARY OF THE INVENTION

In U.S. Pat. No. 5,566,478 the mechanism for rotatably mounting the traction pad is located in a circular cavity formed in the bottom surface of the shoe sole. In some cases, particularly with shoe soles that are relatively thin or lack strength, the cavity might unduly weaken the sole. In some cases the cavity might enable the traction pad to punch through or deform the sole, making the shoe uncomfortable to wear.

The present invention is concerned with an athletic shoe having a rotatable traction pad that is at least partially contained within a circular cavity formed in the bottom surface of the shoe sole, with the cavity being relatively shallow so that the cavity does not unduly weaken the shoe sole. In preferred practice of the invention the traction pad is rotatably supported by means of an anti-friction bearing that is contained within an annular bearing housing that is adhesively bonded to the circular side surface of the cavity.

With such an arrangement the load forces on the traction pad are largely distributed to relatively thick areas of the shoe sole surrounding the circular cavity (not to the roof area of the cavity). By spreading the load forces into relatively thick areas of the sole it comes possible to maintain the overall strength of the shoe sole, the ensure a comfortable fit of the shoe on the person's foot. The invention has particular application to shoes that have relatively thin soles.

DESCRIPTION OF A PREFERRED EMBODIMENT OF THE INVENTION

Figure 1:
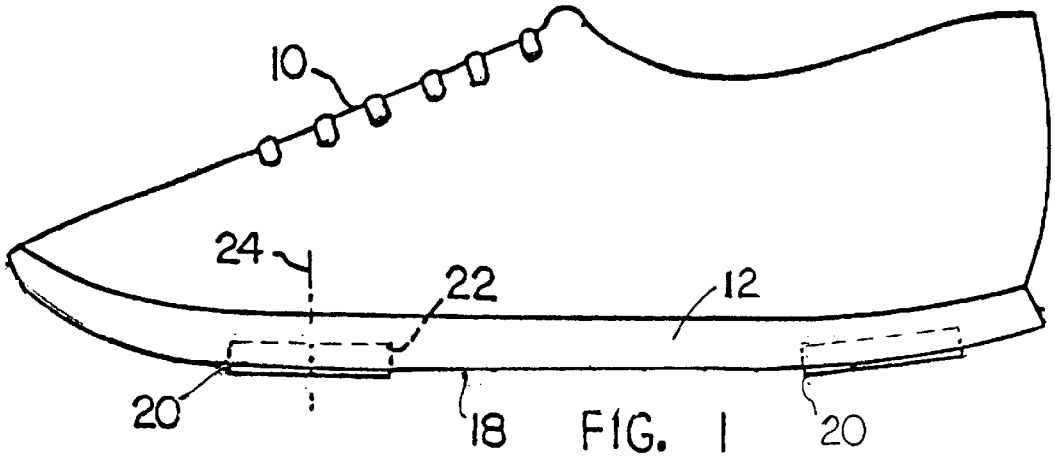
FIG. 1 is a side elevational view of a shoe having rotatable traction pads of the present invention mounted in the toe area and heel area of the shoe sole.
Figure 2:
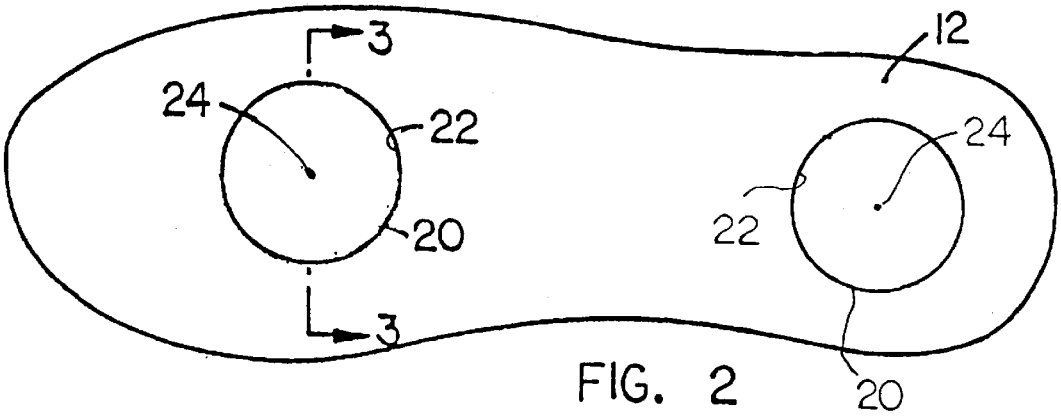
FIG. 2 is a bottom plan view of the shoe illustrated in FIG. 1.

FIGS. 1 and 2 show a generally conventional sports shoe 10 having a sole 12 formed of rubber or similar elastomeric materials having cushioning properties and traction capabilities. In some cases, such as a football shoe or a dance shoe, the sole might be formed of leather or a composition material. Botton surface 18 of the sole can have grooves or slots therein for improving the traction on a ground or pavement or floor surface.

The invention is more particularly concerned with a rotatable traction pad 20 located within a circular cavity 22 formed in the bottom surface 18 of the shoe sole. The rotatable nature of the traction pad enables the pad to be anchored to the ground surface during a shoe turning maneuver, thereby enabling the shoe to more easily turn with the person's foot so as to minimize stress on the person's ankle.

FIGS. 1 and 2 show the shoe equipped with two rotatable traction pads 20, one located on the toe area of the shoe sole and the other located on the heel area of the shoe sole. FIGS. 1 and 2 are merely illustrative of the traction pad locations that can be employed in practice of the invention. In a given instance (e.g. a tennis shoe or a basketball shoe) the rotary traction pad can be incorporated into the toe area of the shoe sole. In another instance (e.g. a dance shoe), the rotary traction pad can be mounted in the heel area of a shoe sole.

As shown in FIGS. 1 and 2, the two rotary traction pads 20 are the same size. However, they can be of different sizes in accordance with the available sole surface area and pad area required to achieve the desired anchorage on a particular terrain. The two rotary traction pads can be similarly constructed. In each case, the rotatable traction pad is located within a circular cavity 22 formed in the shoe sole bottom surface 18. Each traction pad is mounted for relative rotation around a central axis 24 that coincides with the central axis of circular cavity 22.

Figure 3:
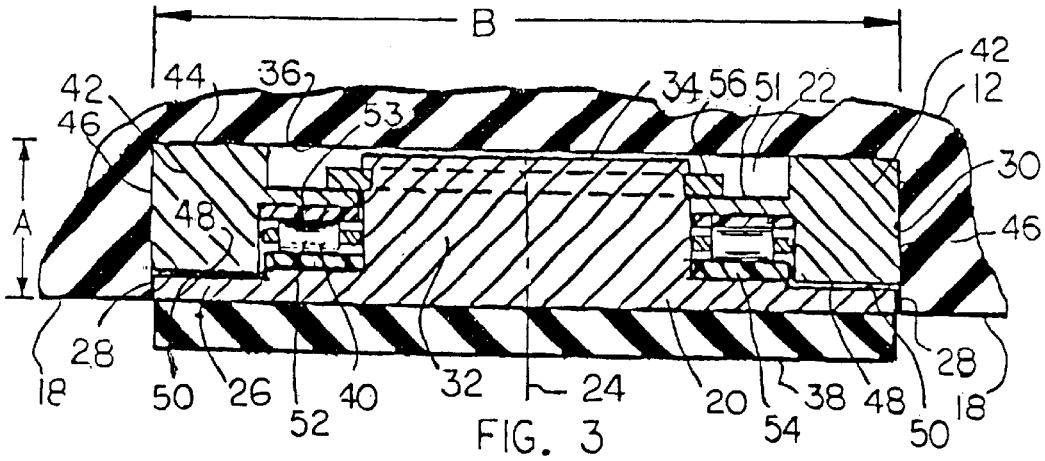
FIG. 3 is a fragmentary sectional view taken on line 3—3 in FIG. 2.
Figure 4:
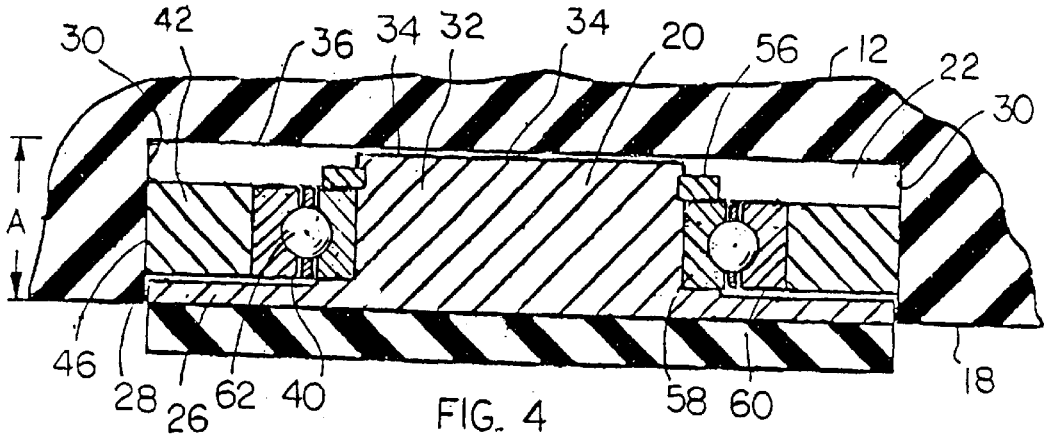
FIG. 4 is a sectional view taken in the same direction as FIG. 3, but showing another traction pad constructed according to the invention.
Figure 5:
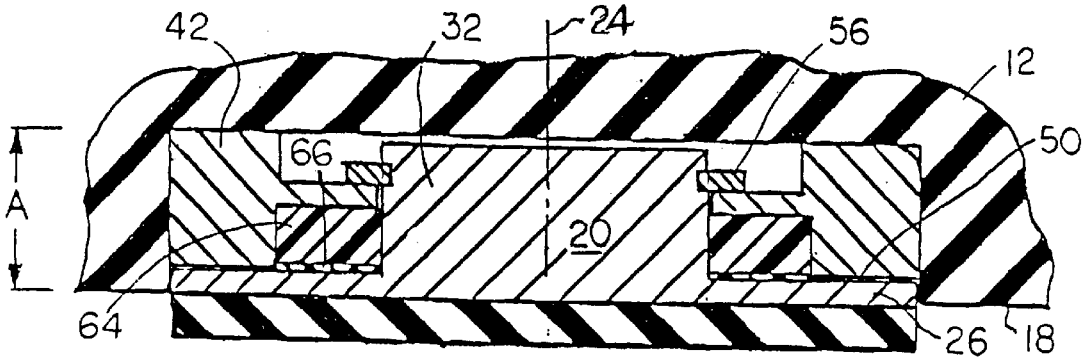
FIG. 5 is a sectional view, taken the same direction as FIGS. 3 and 4, but showing another traction pad embodying the invention.

FIGS. 3, 4 and 5 show different pad constructions that can be employed in practice of the invention. As shown in FIG. 3, the traction pad 20 comprises a rigid flat circular plate 26 having a circular edge 28 in close clearance relation to circular side surface 30 of the associated cavity 22, for minimizing the entry of dirt into cavity 22. Traction pad 20 further includes a circular post 32 extending upwardly from plate 26 so that it's free end 34 is in close proximity to roof surface 36 of cavity 22.

Traction pad 20 is preferably a one piece structure, wherein circular plate 26 and post 32 are integrated together as a unit. The lower face of plate 26 carries a traction disk 38, preferably of the same material as shoe sole 12.

Traction pad 20 is a rigid one piece unit, formed of a material that is non-deformable and resistance to compression forces. The one piece unit can, for example, be formed of aluminum (for lightness) or a rigid polymer (e.g. nylon), or a composite material having reproducible dimensional qualities. Resistance to deformation under compressive forces is a principal requirement for the traction pad material.

As previously noted, cavity 22 has a roof surface 36 and a cylindrical side surface 30 extending from the roof surface to the shoe sole bottom surface 18. Cavity 22 is preferably a relatively shallow cavity having a depth dimension A that is relatively small in relation to the vertical thickness of shoe sole 12. Typically, cavity 22 has a depth dimension A that measures about 0.33 inch, whereas shoe sole 12 has a vertical thickness varying from about three fourth inch to one inch or more (depending on the type of shoe).

By keeping the depth dimension A of the circular cavity 22 small in relation to the shoe sole thickness, it is possible to minimize the weakening effect of the cavity on the overall strength of the shoe sole.

The diameter dimension B of the circular cavity is also kept reasonably small in order to maintain the overall strength of the shoe sole. Typically, the cavity diameter is about one and three quarter inch.

Traction pad 20 is rotatably mounted for rotation around central axis 24, by means of an anti-friction bearing 40 that is supported on an annular housing 42. As shown in FIG. 3, the housing is a one piece rigid structure that includes an upper end surface 44 abutting the cavity roof surface 36, an annular circular side surface 46 mated to the cavity side surface 30, and a lower end surface 48 having a close clearance relation to the upper surface 50 of circular plate 26. The housing further includes a radial flange 51 that projects radially inwardly toward post 32.

Housing 42 can be formed of various rigid materials, e.g. aluminum, or a rigid polymer, or a high strength composite. The housing is adhesively bonded to the circular side surface 30 of cavity 22, so that axial loads on housing 42 are distributed to cavity side surface 30 and the areas of shoe sole 12 surrounding cavity 22. This minimizes the loadings on cavity roof surface 36, and indirectly prevents undesired vertical deformation of the shoe sole (especially the sole material that defines cavity roof surface 36).

The anti-friction bearing 40 shown in FIG. 3 is a thrust bearing that includes an array of rollers 52 floatably mounted in a separator that is located between an upper anti-friction disk 53 and a lower anti-friction disk 54. Each disk can be formed of polytetrafluoroethylene or other polymer having low surface friction properties. The disks are optional.

Traction pad 20 is retained in an operating position by a retainer 56 that is releasably secured to circular post 32 near the post free end 34. As shown in FIG. 3, retainer 56 includes a snap ring seated in a mating groove in the post 32 side surface so as to vertically overlap the inner edge area of housing flange 51. Other retainer constructions can be employed, e.g. a lock nut threaded onto the end of post 32, or a sleeve press fit on the post free end.

Retainer 56 prevents axial play of traction pad 20 toward or away from cavity roof surface 36, so that the traction pad is retained in an operating position wherein rollers 52 have firm rolling contact with the bearing surfaces on disks 53 and 54.

Retainer 56 is spaced a predetermined axial distance from plate 26, so that housing end surface 48 has only a slight running clearance relative to the upper surface 50 of plate 26, e.g. on the order of 0.001 inch. A slight running clearance is beneficial in that it tends to prevent undesired migration of dirt into cavity 22 (where such dirt could clog the bearing).

Traction pad 20, anti-friction bearing 40 and housing 42 are assembled together prior to insertion of the operating components into circular cavity 22. Retainer 56 is inserted onto post 32 to retain components 20, 40 and 42 together as a sub-assembly. The sub-assembly is then inserted into cavity 22 and fixed in place by an adhesive extending along the interface between housing side surface 46 and cavity side surface 30.

As shown in FIG. 3, the vertical (axial) thickness dimension of annular housing 42 is almost as great as the cavity depth dimension A. This ensures that there is a substantial adhesive bond area between surfaces 46 and 30, even though cavity depth dimension A is relatively small in an absolute sense, e.g. only about one third inch.

During operation of the rotary traction pad, axial load forces on the traction surface (disk 38) tend to displace traction pad 20 upwardly relative to shoe sole 12, so that the adhesive bond between surfaces 46 and 30 is under a shear stress. Some of the axial load on the traction pad is transferred via the adhesive bond to the areas of sole 12 surrounding cavity 22, so as to somewhat reduce the axial loadings on cavity roof surface 36.

The axial thickness dimension of annular housing 42 is preferably at least sixty percent of the cavity depth dimension A, in order to maximize the adhesive bond area and minimize forces tending to distort the shoe sole 12. In the FIG. 3 arrangement, the axial thickness of housing 42 is approximately eighty percent of cavity depth dimension A.

Traction pad 20 is a rigid one piece structure in order to minimize traction pad distortion that could produce undesired frictional interferences between the traction pad and housing 42 (or the cavity surfaces). Housing 42 is located radially outwardly from central post 32 in order to minimize the depth of cavity 22 (typically the cavity has a depth of about 0.33 inch). Components 20, 40 and 42 are held together as a sub-assembly (by retainer 56) so that the sub-assembly can be adhesively secured to shoe sole 12 without forming fastener holes in the shoe sole (that could constitute weak points in the shoe sole).

FIG. 3 represents a presently preferred embodiment of the invention. FIGS. 4 and 5 show other forms that the invention can take.

FIG. 4 shows an arrangement wherein annular housing 42 is a radially thickened sleeve having flat upper and lower ends. The housing does not have an inwardly radiating flange, as in the FIG. 3 arrangement.

The anti-friction bearing 40 is a radial bearing that includes an inner race 58 having a close fit on post 32, an outer race 60 adhesively bonded to the inner surface of housing 42, and an array of anti-friction balls 62 interposed between the two races. The grooves in races 58 and 60 are deep enough so that bearing 40 can act as a thrust bearing. Bearing 40 can be a commercially available sealed anti-friction bearing.

In the operation of assembling the FIG. 4 traction pad, anti-friction bearing 40 is initially bonded to annular housing 42. After the bearing has been placed on post 32, retainer 56 is installed on post 32 to position traction pad 20 in operative connection with bearing 40 and housing 42. The sub-assembly of components 20, 40 and 42 is installed as a unit in cavity 22. As in the FIG. 3 arrangement, the annular side surface 46 of housing 42 is adhesively bonded to cavity side surface 30 to retain the rotatable traction pad in its operation position.

In the FIG. 4 arrangement, the axial thickness dimension of annular housing 42 is approximately sixty percent of the cavity depth dimension A. While this percentage is less than the eighty percent in FIG. 3, nevertheless there is sufficient surface area on housing side surface 46 to obtain a satisfactory adhesive bond between housing 42 and cavity surface 30.

In an operational sense, the FIG. 4 construction operates in the same general fashion as the FIG. 3 arrangement.

The construction depicted in FIG. 5 is the same as that shown in FIG. 3 except for the type of anti-friction bearing that is used. In FIG. 5 the anti-friction bearing comprises an annular disk 64 formed of polytetrafluoroethylene or similar anti-friction bearing material. The disk can have a press fit in housing 42.

The lower surface of anti-friction disk 64 is in rotary sliding contact with a thin wafer 66 that is adhesively bonded to the upper surface of plate 26. Wafer 66 can also be formed of polytetrafluoraethylene. Disk 64 can have an axial thickness of about 0.14 inch; wafer 66 can have an axial thickness of about 0.005 inch. The thickness dimensions are selected, at least partly, so that lower end surface 48 on housing 42 has only a slight running clearance with respect to the upper surface 50 of circular place 26.

In the FIG. 5 arrangement, traction pad 20 is operatively connected to housing 42 by means of a retainer 56 that may be similar to the retainer shown in FIG. 3. The FIG. 5 construction operates in essentially the same fashion as the FIG. 3 construction.

The drawings show illustrative forms that the invention can take. However, it will be appreciated that the invention can be practiced in other forms and configurations.

What is claimed:

1. In a shoe that includes a sole having a bottom surface, the improvement comprising:

a circular cavity in the shoe sole bottom surface;

a circular traction pad located within said cavity; said traction pad having a central axis; and means for rotatably mounting said traction pad in said cavity, whereby the pad is rotatable around said central axis;

said circular cavity having a roof surface and a cylindrical side surface extending from said roof surface to the sole bottom surface;

said traction pad comprising a rigid flat circular plate having a circular edge in close clearance relation to the cavity side surface, and a rigid circular post extending axially from said plate; said post having a free end located in close proximity to the cavity roof surface;

said mounting means comprising an annular bearing housing bonded to the cavity side surface, an annular anti-friction bearing interposed between said housing and said traction pad, and a retainer releasably secured to said circular post near the post free end for preventing axial play of the traction pad toward or away from the cavity roof surface;

said housing having an axial thickness dimension that is a significant percentage of the distance from the cavity roof to the sole bottom surface, whereby the bond between the housing and the cavity side surface has a substantial surface area.

2. The improvement of claim 1, wherein said circular post and said flat circular plate are integrated together as a one piece structure.

3. The improvement of claim 1, wherein said annular housing has an annular end surface facing away from the cavity roof surface; said flat circular plate having a flat upper surface in close clearance relation to said housing end surface for minimizing the flow of dirt into the traction pad cavity.

4. The improvement of claim 1, wherein said retainer is a snap ring.

5. The improvement of claim 1, wherein said annular housing has an annular end surface facing away from the cavity roof surface, said flat circular plate having a flat upper surface in close clearance relation to said housing end surface for minimizing the flow of dirt into the traction pad cavity; said retainer comprising a snap ring spaced from said circular plate a predetermined distance to establish the clearance between said housing end surface and said plate upper surface.

6. The improvement of claim 1, wherein said annular housing has a radial flange projecting radially inwardly toward said circular post; said retainer comprising a snap ring projecting radially from said post so as to overlap said housing flange.

7. The improvement of claim 1, wherein said anti-friction bearing is a thrust bearing.

8. The improvement of claim 1, wherein said annular housing has a radial flange projecting radially inwardly toward said circular post; said anti-friction bearing being located between said radial flange and said flat circular plate.

9. The improvement of claim 8, wherein said annular housing has an annular end surface facing away from the cavity roof surface; said flat plate having an upper surface in close clearance relation to said housing end surface for minimizing the flow of dirt into the traction pad cavity; said retainer comprising a snap ring projecting from said post so as to overlap said housing flange; said snap ring being spaced from said circular plate a predetermined distance to establish the clearance between said housing end surface and said plate upper surface.

10. The improvement of claim 1, wherein said bearing comprising a first race seated on said circular plate, a second race seated on said housing, and an array of anti-friction elements located between said races; said retainer comprising a snap ring projecting radially from said post to overlap said first race.

11. The improvement of claim 1, wherein said anti-friction bearing comprises an annular disk formed of a polytetrafluoroethylene anti-friction material.

12. The improvement of claim 1, wherein said circular plate has a lower surface, said traction pad comprising a traction disk (38) secured to said plate lower surface.

13. The improvement of claim 1, wherein said annular bearing housing has an axial thickness dimension that is approximately eighty percent of the distance from the cavity roof surface to the shoe sole bottom surface.

14. The improvement of claim 1, wherein the axial thickness of the annular housing is at least sixty percent of the axial depth of said cavity.

* * * * *